US006792860B2

(12) United States Patent
Schröder et al.

(10) Patent No.: US 6,792,860 B2
(45) **Date of Patent: *Sep. 21, 2004**

(54) METHOD AND DEVICE FOR PRESSING A PACKING AGAINST A CYLINDER

(75) Inventors: Norbert Edmund Schröder, Rieneck (DE); Andreas Ewald Heinrich Bernard, Sulzfeld (DE); Karl Robert Schäfer, Rimpar (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/275,945

(22) PCT Filed: May 16, 2001

(86) PCT No.: PCT/DE01/01840

§ 371 (c)(1),
(2), (4) Date: Nov. 15, 2002

(87) PCT Pub. No.: WO01/87613

PCT Pub. Date: Nov. 22, 2001

(65) Prior Publication Data

US 2003/0167951 A1 Sep. 11, 2003

(30) Foreign Application Priority Data

May 17, 2000 (DE) ..... 100 24 330

(51) Int. Cl.[7] ..... B41F 13/42; B41F 30/00; B41F 27/00

(52) U.S. Cl. ..... 101/477; 101/415.1; 101/216

(58) Field of Search ..... 101/477, 415.1, 101/216, 217, 378, 382.1, 492

(56) References Cited

U.S. PATENT DOCUMENTS

| | | | | |
|---|---|---|---|---|
| 5,309,835 A | * | 5/1994 | Hartung et al. | 101/415.1 |
| 5,617,792 A | | 4/1997 | Rau et al. | |
| 6,009,801 A | * | 1/2000 | Zuber et al. | 100/35 |
| 6,725,778 B2 | * | 4/2004 | Bitterich et al. | 101/477 |
| 2003/0177926 A1 | * | 9/2003 | Bitterich et al. | 101/415.1 |

FOREIGN PATENT DOCUMENTS

| | | |
|---|---|---|
| EP | 0 433 798 B1 | 10/1995 |
| EP | 0 712 725 A2 | 5/1996 |
| EP | 0 710 556 B1 | 12/1998 |
| EP | 0 712 725 B1 | 5/1999 |

* cited by examiner

*Primary Examiner*—Leslie J. Evanisko
(74) *Attorney, Agent, or Firm*—Jones Tullar & Cooper P.C.

(57) ABSTRACT

A packing is pressed against a surface of a cylinder by using at least one roller which is deployed and retracted with respect to the cylinder by an adjusting mechanism. A guard is provided for covering the roller. The guard is actuated by the roller adjusting mechanism. The guard covers the roller in the direction of the cylinder and is actuated with the roller.

9 Claims, 4 Drawing Sheets

METHOD AND DEVICE FOR PRESSING A PACKING AGAINST A CYLINDER

CROSS-REFERENCE TO RELATED APPLICATIONS

The subject U.S. patent application is the U.S. national phase of PCT/DE01/01840, filed May 16, 2001; published as WO 01/87613 on Nov. 22, 2001, and claiming priority to DE 100 24 330.4 filed May 17, 2000.

FIELD OF THE INVENTION

The present invention is directed to a method and to devices for pressing a packing, a cover or a dressing against a cylinder. A roller can be deployed and retracted by an adjusting mechanism and can be covered by a guard.

BACKGROUND OF THE INVENTION

EP 07 12 725 B1 discloses a device that is usable for pressing against printing plates with the aid of a number of rollers which are disposed along the cylinder circumference. In order to protect it from getting dirty, the device is disposed in a box-shaped dirt guard that can be moved out of the deployment region of the rollers. Additional opening flaps are disposed on the dirt guard and can be actuated by separate working cylinders.

EP 04 33 798 B1 has a pivotable guard for a changing device of a printing plate, which pivotable guard protects the entire apparatus, that is oriented toward the access side, from getting dirty. The pressing roller is a one piece roller, and working cylinders situated at both ends of the roller place it against the cylinder by use of a lever.

EP 07 10 556 B1 discloses a device for guiding the trailing end of a plate into a channel during plate installation. In this connection, after the leading end of the plate has been clamped in place, and after most of the plate has been mounted in place, a feeder carriage is moved against the cylinder and guides the trailing end of the plate into the channel by the use of an insertion slider disposed on the carriage.

SUMMARY OF THE INVENTION

The object of the present invention is to produce a method and devices for pressing a packing, a cover or a dressing against a cylinder blanket.

The object is attained according to the present invention by the use of at least one roller which is deployed and retracted by an adjusting mechanism. The roller can be covered, in the direction of the cylinder, by an actuating guard. Both the guard and the roller are actuated by the same adjusting mechanism. A stop on the device that deploys and retracts the at least one roller is engageable by the leading, acutely bent end of the packing, cover dressing or plate to be applied to the cylinder. The stop is inclined toward the cylinder. At one location, the spacing between the stop and the cylinder is less than the height of the acutely bent plate end.

The advantages that can be attained with the present invention are comprised particularly in that a guard is provided for the rollers. This guard limits the possibility of the rollers getting dirty when they are in the retracted position. The rollers and the guard are actuated with the same adjusting mechanism. The movements of both the guard and rollers can therefore occur synchronously and without incurring additional control and drive costs. It is particularly advantageous to couple the movable guards to the roller supports that are moved by the adjusting mechanism.

To accomplish an exact insertion of a leading end of a packing, cover or dressing into a channel in the cylinder, at least one stop is advantageously provided, which stop is stationary in relation to the machine frame. It is advantageous that when installing the packing, cover or dressing, the formation or structure of the stop imparts an initial stress on the leading end of the packing, cover or dressing, which permits the leading end to engage, in detent fashion, in the provided clamping or tensioning device in the cylinder in a manner that is reproducible because it is guided.

BRIEF DESCRIPTION OF THE DRAWINGS

Preferred embodiments of the present invention are shown in the drawings and will be described in detail below.

DESCRIPTION OF THE PREFERRED EMBODIMENTS

Figure 1:
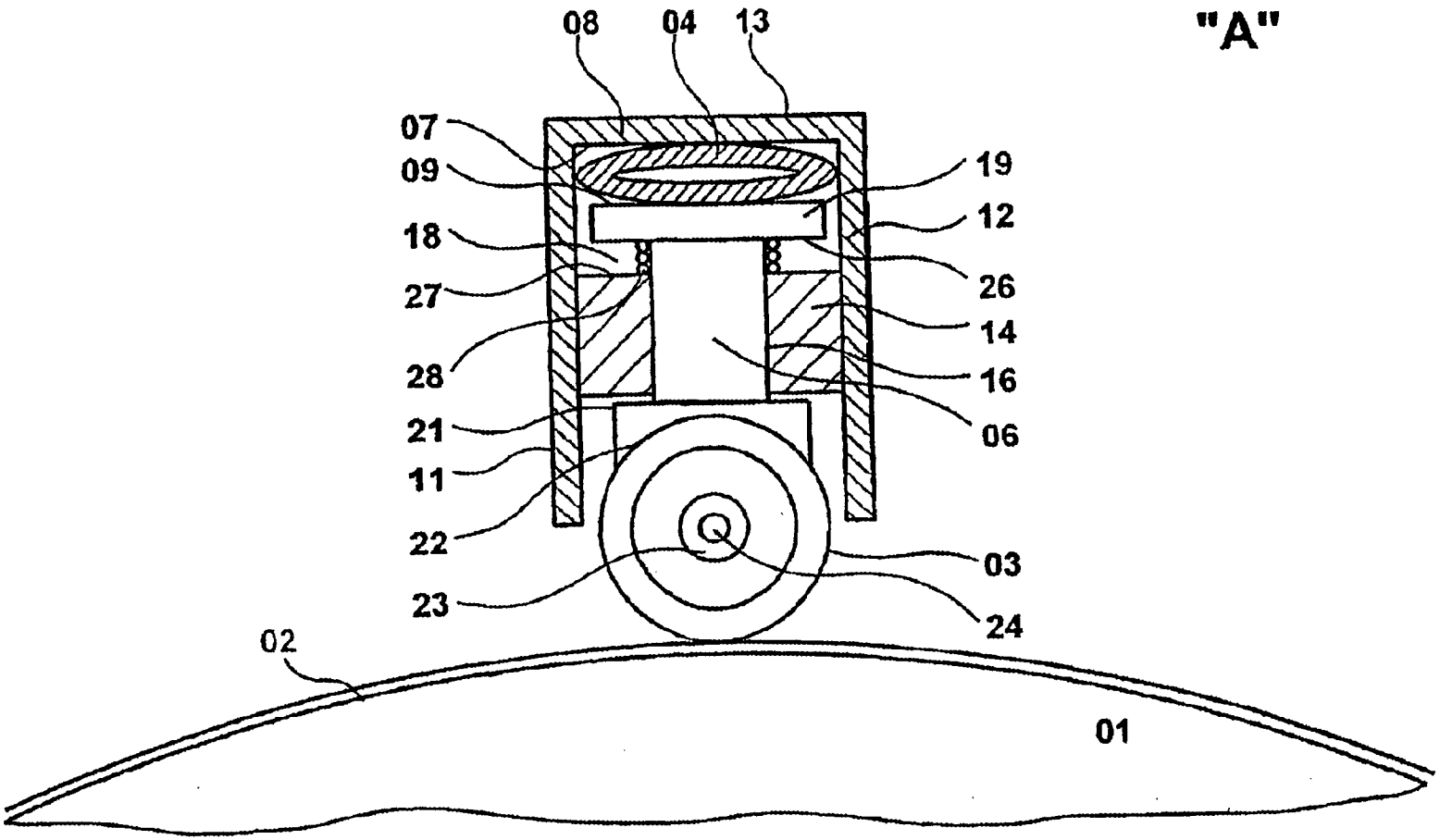
FIG. 1 is a cross-sectional view through a first preferred exemplary embodiment of a device for pressing against the packing, cover or dressing in accordance with the present invention and showing the device in the deployed position A.

A cylinder 01, for example a forme cylinder or a transfer cylinder 01 of a rotary printing press, has a packing, cover or dressing 02, for example a printing plate 02, if cylinder 01 is a forme cylinder or a rubber blanket 02, if cylinder 01 is a transfer or blanket cylinder, disposed on it during operation, as may be seen in FIG. 1. The packing, cover, dressing or blanket 02 will be referred to as a packing hereinafter.

The device for pressing the packing 02 against the cylinder 01 is advantageously disposed so that it is stationary in relation to the cylinder 01, and only cooperates with the cylinder 01 when actuated. In order to install the packing 02 onto the cylinder 01 or in order to remove the packing, a device for pressing against the packing 02 similar to the one depicted in FIG. 1 can also be pivoted against the cylinder 01 by the use of a device that is not described in detail here. This can, for example, be achieved by the use of pivotable lever arms, through linear motion against a threaded spindle, or with other linear drive mechanisms.

When the device for pressing against a packing 02 is in the operational state, as depicted in FIG. 1, i.e. when changing the packing blanket 02, the device extends with its longitudinal direction approximately parallel to an axis of rotation of the cylinder 01. During installation or removal of the packing 02, a number of rollers 03, which are associated with the pressing device, are pressed against the rotating cylinder 01 by the operation of an adjusting mechanism, generally at 04.

The packing pressing device essentially has a number of rollers 03 which are spaced apart from one another in the longitudinal direction of the cylinder 01, roller supports 06 that support the rollers 03, the adjusting mechanism 04, a support surface 07, and possibly a frame 08. For example, the frame 08 can be disposed, in a stationary or mobile fashion, on a machine side frame that is not specifically shown. For example, the adjusting mechanism 04 is embodied as a reversibly deformable hollow body 04, such as, for example a hose 04, which can be acted on with pressure fluid. The frame 08 serves to contain the roller supports 06 and the hollow body 04 and can include the support surface 07. When acted on by pressure fluid, the hollow body 04 is caused to expand against the support surface 07 and places the roller 03 against the cylinder 01 by engageable with a surface 09 of the roller support 06 that cooperates with the deformable hollow body 04.

In a first preferred embodiment of the device for pressing a packing against a cylinder in accordance with the present invention, the frame 08 is disposed approximately parallel to the rotation axis of the cylinder 01 in the longitudinal direction of the cylinder 01 and is configured as an approximately U-shaped crossbar 08 that has a base 13 and depending legs 11; 12 on opposite sides of the base 13. Between the legs 11; 12, and oriented away from the base 13, there is a strip 14. A number of guides 16 extend through the strip 14, which guides 16 are spaced apart from one another in the longitudinal direction of the cylinder 01. For example, each guide 16 in the strip 14 is configured as a bore or as a bore containing a sleeve or a bearing bushing and allows a strut, rod or tappet 17, that is associated with or a part of the roller support 06 to move in a longitudinally guided fashion.

The strip 14, together with the two depending legs 11; 12, and the base 13, form a hollow chamber 18 that is extending in the longitudinal direction of the cylinder 01. On its side oriented toward the hollow chamber 18, the base 13 of the U-shaped cross bar has the support surface 07 that, as discussed above, cooperates with the inflatable hollow body 04. The legs 11; 12 can also be embodied as struts or can be omitted entirely.

The inflatable or expandable hollow body 04 is disposed in the longitudinal direction in the hollow chamber 18 between the two legs 11; 12, the base 13 with the support surface 07, and the surfaces 09 of the roller supports 06 that cooperate with the hollow body 04.

The roller support 06, which is embodied with two arms, essentially has a head 19 which is embodied, for example as a plate 19, and which plate 19 is disposed in the hollow chamber 18 of the frame 08, and cooperates with the hollow body 04. Roller support 16 also has two struts, rods, or tappets 17 that each protrude through a respective guide 16 of the strip 14 and are each provided with a foot 21, which supports the roller 03. The strut 17, which may be, for example a cylindrical rod 17, is disposed so that it can slide in respect to its longitudinal direction in the guide 16 of the strip 14. Rod 17 connects the other components of the roller support 06 at its respective ends, namely connecting the plate 19 disposed in the hollow chamber 18 to the foot 21, which is disposed outside the hollow chamber 18, which foot 21 supports the roller 03, and which is embodied, for example, in the form of a leg 21. The cross section of the rod 17 approximately corresponds to the cross section of the guide 16 and/or to the inner diameter of a bearing bushing or a sleeve provided in the guide 16 for better axial guidance of the rod 17.

On at least one of its side surfaces 22, the leg 21 has a radial bearing 23, for example a bearing bushing 23 for use in containing an axle 24 that is associated with the roller 03. The roller 03 is disposed between the two legs 21 so that its longitudinal axis extends approximately parallel to the rotation axis of the cylinder 01 during a plate change.

At each of its ends, the roller 03 has an end of the axle 24, which axle 24 either passes all the way through the roller 03 or is discontinuous. These axle ends each cooperate with an associated bearing bushing 23 in their associated leg 21. The roller 03 can be a rubber roller, a plastic roller, or a different roller 03 whose running surface is provided with a soft covering that does not damage the packing 02.

On its side oriented toward the hollow body 04, the roller support head or plate 19 has the first surface 09 that cooperates with the deformable hollow body 04. A second surface 26 of the plate 19, opposite from the first surface 09, cooperates as a stop 26 with the surface 27 of the strip 14 which is oriented toward the hollow chamber 18. It is advantageous to dispose at least one flexible element 28, such as, for example a spring 28, between the surface 27 of the strip 14 and the surface 26 of the roller support head or plate 19. This is achieved, for example, by the spring 28 either encompassing the rod 17 or being inserted into recesses in the plate 19 and the strip 14.

The roller support 06 can also be embodied as being one-armed, wherein each rod or tappet 17 is associated with an individual plate 19 that is disposed in the hollow chamber 18. In this embodiment, two roller supports 06, each respectively disposed in the guide 16, cooperate to support the roller 03. The plate 19, rod 17, and legs 21 can also be embodied of one piece with one another, wherein the roller support 06, at the end protruding into the hollow chamber 18, i.e. the head 19, advantageously has an enlarged cross section or at least a stop 26, and at least on an end protruding from the strip 14, such as the foot 21, has a bearing bushing 23.

The head 19 of the roller support 06 can also be embodied as a plate 19, which extends over several rollers 03 and on which the rods 17 and feet 21 for several rollers 03 are disposed.

In each embodiment of the device for pressing a packing against a cylinder, the roller supports 06 and rollers 03 are disposed on the strip 14 so that the rollers 03 that are spaced apart from each other in the longitudinal direction are each supported so that they can each rotate around an axis of rotation which is extending approximately parallel to the rotation axis of the cylinder 01 when the device for pressing against the cylinder 01 is pivoted.

The device for pressing a packing 02 against a cylinder 01, and with a number of first rollers 03, in accordance with the first preferred embodiment functions as follows. In order to change the printing plate or other packing 02, the pressing device is pivoted against the cylinder 01 so that the rotational axis of the cylinder 01 and the axle 24 of the roller 03 extend approximately parallel to each other. In this position of the device, the deformable hollow body 04 is acted on by pressure fluid. When the hollow body 04 is acted on by pressure fluid and the resulting reversible shape change to the hollow body 04 occurs, the deformable hollow body 04 is supported against the support surface 07 and presses all of the roller supports 06 resting against the hollow body 04 with their support surfaces 09 simultaneously, counter to the force of the springs 28, outward, and with the same pressure, against the packing 02. The rollers 03 and roller supports 06 are now disposed in the deployed position "A", as seen in FIG. 1. A slight deviation in the position of the device or an inclination of the cylinder 01 is compensated for by the pressure uniformly prevailing over the entire length of the hollow body 04 by virtue of the fact that rollers 03, which are spaced further apart from the cylinder 01, are displaced further out from the hollow chamber 18. All of the roller supports 06 are pushed out from the hollow chamber 18 until they come into contact with, and exert the same force against the packing 02. However, the latter only occurs in the tolerance range established by the length of the rod 17 protruding into the hollow chamber 18.

In another preferred embodiment of the present invention, in addition to the first rollers 03, which are spaced apart from one another and which are placed against the cylinder 01 in order to install new packings 02 onto it, the device can also have a number of second rollers 29, which are placed against the packing 02 in order to remove it. This second preferred embodiment of the present invention is depicted in FIG. 2.

Figure 2:
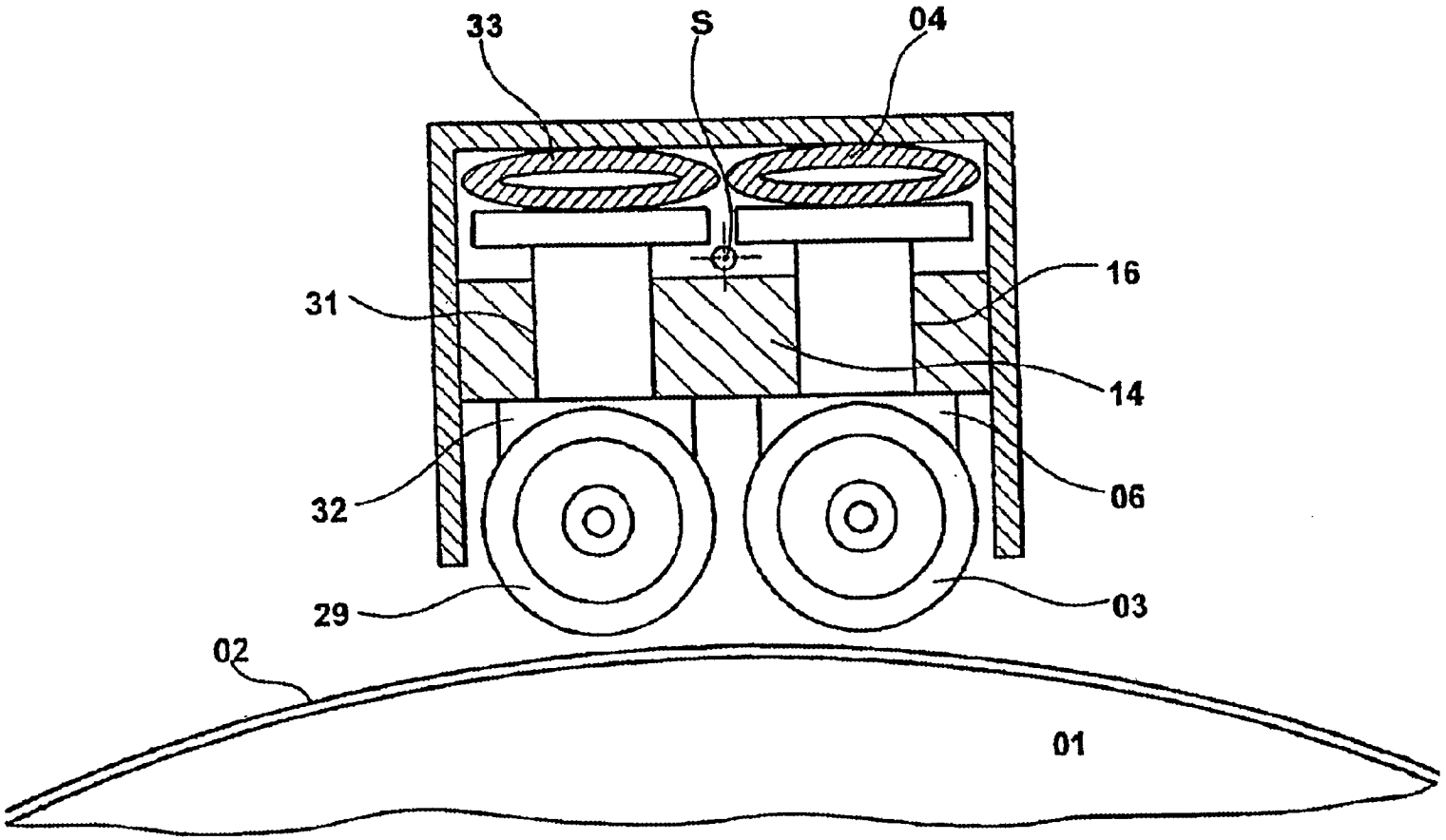
FIG. 2 is a cross-sectional view through a second preferred embodiment of the present invention, and using first and second rollers for installation and removal of the packing, cover or dressing.

In the second embodiment of FIG. 2, with a number of first rollers 03 and a number of second rollers 29, the widened U-shaped frame 08 contains a widened strip 14, which has a row of second guides 31 in the longitudinal direction of the device, with these second guides 31 being parallel to the row of first guides 16. The second roller supports 32, with the second rollers 29, which are disposed parallel to the first rollers 03, are supported so that they can slide in these second guides 31. A second adjusting mechanism 33 such as, for example a second deformable hollow body 33, is disposed in the hollow chamber 18 between the support surface 07 and the surfaces 34 of the second roller supports 32 and is cooperating with the first deformable hollow body 04. The first roller supports 06 and the second roller supports 32 can also be actuated by a single deformable hollow body 04 that would be correspondingly embodied and positioned in a manner similar to the first and second deformable bodies 04 and 33, respectively.

In accordance with the second preferred embodiment, in order to change the packing 02, first the second rollers 29 are placed against the cylinder 01. This placement of rollers 29 can be executed by acting on the deformable hollow body 33 with pressure fluid and additionally by pivoting the frame 08 if need be around a pivot axis ending in the longitudinal direction, for example about a shared pivot axis S, so that only the second rollers 29 are disposed in the deployed position A and cooperate with the packing 02. After the old packing 02 is removed, a new packing 02 is then secured in place. The hollow body 04 is acted on with pressure fluid and the frame 08 is pivoted, if need be, in the opposite direction so that only the first rollers 03 cooperate with the new packing 02 and are disposed in the deployed position A.

If the first roller supports 06 and second roller supports 32 are actuated jointly by pressurization of a single deformable hollow body 04, then the selection of the rollers 03 or 29 to be activated is executed exclusively by pivoting the frame 08 around the axis extending in the longitudinal direction, for example the pivot axis S. The uniform adjusting force exerted against the cylinder 01 or against a packing 02 on the cylinder 01 for a number of rollers 03 or 29 associated with one deformable hollow body 04 is exerted by acting on the one deformable hollow body 04 with pressure fluid.

Figure 3:
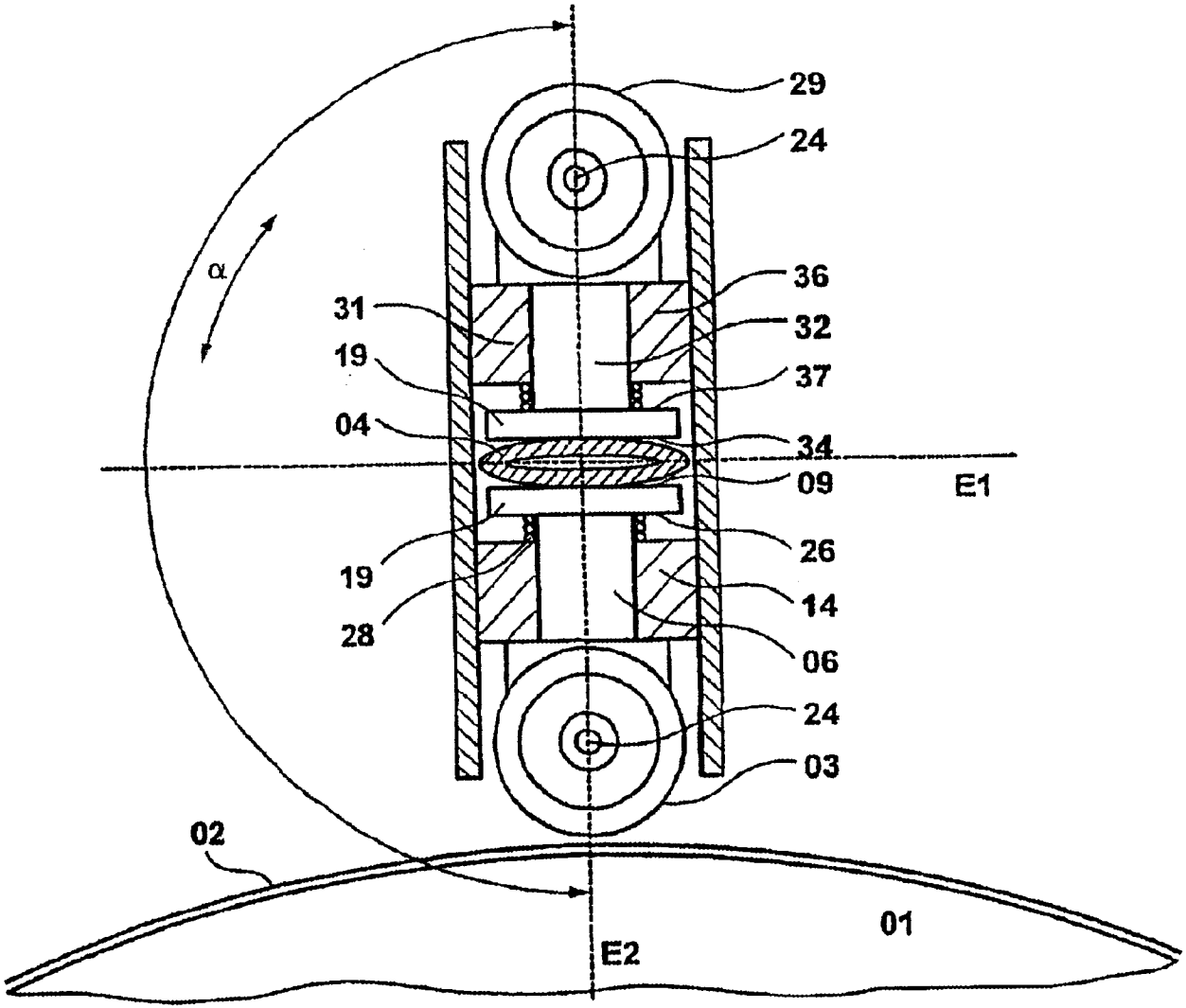
FIG. 3 is a cross-sectional view through a third preferred embodiment of the present invention, and using first and second rollers for installation and removal of the packing, cover or dressing.

In a third preferred embodiment of the present invention, as shown in FIG. 3, for the arrangement of a number of first rollers 03 and of second rollers 29, the first rollers 03 and the second rollers 29 are situated approximately diametrically opposite from each other on the frame 08. In contrast to the device described in conjunction with FIG. 1, in this third embodiment, the base 13 that borders the hollow chamber 18 is eliminated. Instead of the base 13, a second strip 36 with second roller supports 32 and the second rollers 29 is provided, which is mirror symmetrical to a plane, the plane of symmetry E1, and to the hollow body 04. The second roller supports 32 have surfaces 34 that cooperate with the hollow body 04 and have a surface 37 that cooperates as a stop 37 with the second strip 36. The legs 11; 12 can be elongated, thus assuring the device of being covered at the sides. The device for pressing a packing 02 against a cylinder 01, as depicted in FIG. 3 can be pivoted by use of a device, which is not specifically shown, in relation to the longitudinally extending pivot axis S, which lies in the plane of symmetry E1 and which extends parallel to the axles 24 of the first rollers 03 and to the axles 24 of the second rollers 29. With a diametrical disposition of the rollers 03; 29, the shared pivot axis S advantageously coincides with the line of the plane of symmetry E1 and an intersecting plane E2 extending through the axles 24 of the first rollers 03 and the second rollers 29.

In order to change the packing 02 by use of the third preferred embodiment, initially the second rollers 29 are placed against the cylinder 01. This is accomplished by pivoting the frame 08 around the longitudinally extending pivot axis S and then acting on the deformable hollow body 04 with a pressure fluid so that the second rollers 29 cooperate with the packing 02 and are disposed in the deployed position A. In this connection, the two roller supports 06; 32 for the rollers 03 and 29, respectively are pushed apart from each other, for example until the stop 26 of the freely moving roller support 06 cooperates with the first strip 14. In a manner that corresponds to the support surface 07 from the first preferred embodiment which is depicted in FIG. 1, the surface 09 of the first roller support 06 cooperates with the hollow body 04 as a support surface 09. When the deformable hollow body 04 relaxes, the roller support 32 is reset by the spring 28. After the old packing 02 is removed and the new packing 02 is secured in place, the frame 08 is pivoted, for example by 180°, so that after the deformable hollow body 04 is again acted on with pressure fluid, the first rollers 03 cooperate with the new blanket packing 02 and are disposed in the deployed position A. When the hollow body 04 is again acted on, the stop 37 cooperates with the second guide 36 and the surface 34 cooperates as a support surface 34 with the deformable hollow body 04.

The first roller supports 06 and the second roller supports 32 can also be disposed at other angles a enclosed between the first rollers 03, the hollow body 04, and the second rollers 29, as shown in FIG. 3. The second and third preferred embodiments, as depicted in FIGS. 2 and 3, show the two extremes for a number of first rollers 03 and a number of second rollers 29 disposed next to one another in parallel ($\alpha$=0°) and diametrically opposite one another in relation to the hollow body 04 ($\alpha$=180°).

Figure 4:
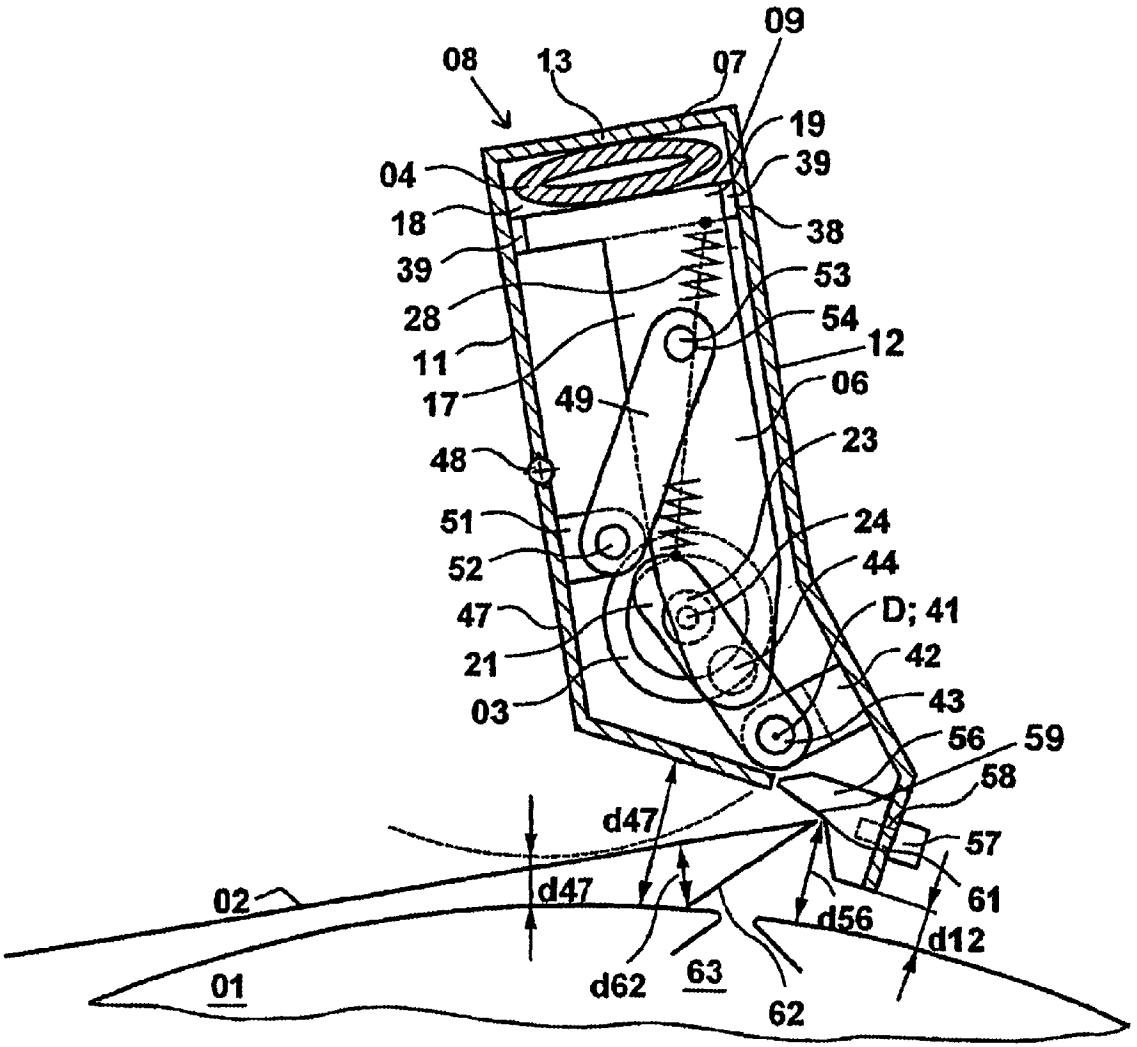
FIG. 4 is a cross-sectional view through a fourth preferred embodiment of the present invention, and with an increased stroke of the roller movement, pivoting guards for covering the rollers, and a stop for the secure insertion of the leading plate end.

The fourth preferred embodiment of the present invention, as shown in FIG. 4, shows another device for pressing against the packing 02, in which the stroke produced by the deformation of the deformable hollow body 04 is multiplied into an increased movement of the rollers 03.

As seen in FIG. 4, the deformable hollow body 04 and several rollers 03 are disposed, extending longitudinally approximately parallel to the rotation axis of the cylinder 01, in the frame 08. The frame 08 is an approximately U-shaped crossbar 08 with a base 13 and legs 11; 12 disposed opposite each other. In an advantageous embodiment, the leg length of the leg 12 is embodied as longer than the length of the leg 11. The leg 12 of the U-shaped crossbar 08 can open outward at its outer end.

The deformable hollow body 04 is disposed inside the U-shaped crossbar frame 08, extending in its longitudinal direction, between the support surface 07 associated with the base 13, the legs 11 and 12, and the upper surfaces 09 of the heads 19 of the roller supports 06 cooperating with the hollow body 04.

The roller support 06 essentially has the head 19, which cooperates with the deformable hollow body 04, and has at least one strut rod, or tappet 17 on which the roller support foot 21 is disposed and that respectively supports the roller 03. The strut 17 is at least disposed with its head 19 positioned between the legs 11; 12 in the frame 08. It is advantageous to provide one roller support 06 for each roller 03, and with the roller support 06 having two struts 17, each strut being provided with a foot 21 for supporting the roller 03.

On its side oriented toward the hollow body 04, the head 19 of the roller support 06 has the upper surface 09, as discussed above, and approximately perpendicular to this upper surface 09, the head 19 has two side surfaces 38, with which the roller support head 19 of the roller support 06 is supported against the leg 11 and/or 12 of the frame 08. For example, the head 19 may be embodied as a plate 19. The side surface 38 can also be the surfaces oriented toward the leg 11, 12 of several sliding feet 39 or supporting feet 39 that are disposed next to, and which are spaced apart from each other and are disposed on the plate 19, on the sides oriented toward the legs 11; 12. The strut, rod or tappet 17 connects the plate 19, which is disposed at its first end, to the roller support foot 21 of the roller support 06, which is disposed at its second end, and which supports the roller 03. The plate 19 and the two struts 17 can also be embodied as being of one piece with one another.

In contrast to the roller support foot 21, which is rigidly connected to the strut 17 in the first preferred embodiment, in the fourth preferred embodiment, the foot 21 of the roller support 06 is embodied as a rocker or as a one-armed lever 21, which is actuated by movement of the strut 17 that functions as a tappet 17. The lever 21 is supported so that it can rotate around a fulcrum 41 situated at a first end of the lever 21.

The fulcrum 41 of the lever 21 is disposed on a rotation axis D, which extends approximately perpendicular to the longitudinal direction of the strut 17 and approximately parallel to the axle 24 of the rollers 03 and which is stationary in relation to the frame 08. For example, this fulcrum 41 is embodied as a linkage comprised of a fork head 42 fastened to the frame leg 12 and a bolt 43 that passes through the fork head 42 and the lever 21.

At a point that is spaced from the fulcrum 41, the strut 17 engages the lever 21. The lever 21 and strut 17 are connected to each other so that they can rotate around an axis which is approximately parallel to the axle 24 of the rollers 03. This connection is made, for example, by the use of a bolt 44, which is disposed in aligned bores in the lever 21 and in the strut 17.

The bearing bushing 23 or a similar mechanism, which is suitable for supporting the roller 03, is disposed at the second end of the lever 21 opposite from the fulcrum 41. In an advantageous configuration, two levers 21 can be associated with a single roller support 06 to respectively support one roller 03. The roller 03 is disposed between the two levers 21 so that its axle 24 extends approximately parallel to the axis of the cylinder 01 when the levers 21 are actuated by movement of the respective strut 17 of the roller support 06.

The rollers 03 can also be placed against the cylinder 01 by use of two-armed levers and by differently structured or differently positioned linkage elements, wherein when acted on with pressure fluid, the deformable hollow body 04 actuates a drive element through its reversible deformation, and the stroke of the resulting linear movement on the drive element is translated, possibly by a corresponding coupling, into a movement of the rollers 03. It is advantageous to provide a transmission or a linkage, which multiplies the stroke of the linear movement generated in the push rod or tappet 17, during deformation of the hollow body 04, into a greater movement of the rollers 03.

The resetting of the rollers 03 or of the roller support 06 is advantageously produced by a spring force. For example, a spring 28 acting on the lever 21 can be fastened to the frame 08 or the strut 17. It is also possible to place a compression spring between the head 19 and a stop that is not shown.

In a preferred configuration of the present invention, when the device is not actuated, the U-shaped profile of the frame 08 is closed by the provision of one or more guards 47 which are disposed next to one another in the longitudinal direction of the frame 08. Each guard 47 is fastened to the shorter leg 11 of frame 08, as seen in FIG. 4, and can pivot in relation to an axis extending in the longitudinal direction of the frame 08, for example by the use of a hinge 48, a strap hinge, or articulating joints. The guard 47 is configured so that it completes the frame 08 in the circumference direction on the shorter leg 11 and at the open end of the U-shaped cross section. When the lengths of legs 11 and 12 are the same, the guard 47 only closes off the open end of the U-shaped frame 08.

On the side oriented toward the inside of the frame 08, the guard 47 has, for example, a coupler 49, which is disposed, at a first end, on the guard 47 and at a second end, on the roller support 06, and preferably on the strut 17, so that coupler 49 can pivot around an axis approximately parallel to the longitudinal direction of the frame 08. The pivoting connection of the coupler 49 to the guard 47 is embodied, for example, as a hinge joint with a link plate 51 and a bolt 52, all as seen in FIG. 4. The coupler 49 is fastened to the strut 17 for example by the use of a bolt 53, which is received, in a form-fitting manner, in a bore 54 in the strut 17. The guard 47 and the coupler 49 are disposed on the frame 08 or on the strut 17 so that when the roller support 06 is in the rest position, i.e. when the strut 17 is not slid toward the opening in the frame 08 by the pressurization of the deformable hollow body 04, the guard 47 and the U-shaped frame 08 together encompass the rollers 03 and the adjusting mechanism. In other words they completely enclose the roller support 06 and the hollow body 04.

The guard 47 can also be coupled to the roller support 06 by other linkage arrangements so that it is opened or closed simultaneously during deployment or retraction of the rollers 03 without incurring additional drive or control costs. It is also possible to provide a parallel arrangement of a number of deformable hollow bodies 04 next to each other in the longitudinal direction of the cylinder 01 or one after or beside the other, in the circumference direction of the cylinder 01, for example in order to actuate first or second rollers 03; 29 in a manner that corresponds to the apparatus according to the second preferred embodiment, as shown in FIG. 2. The first and second rollers 03; 29 can also be disposed next to one another, for example in alternating fashion, in the longitudinal direction of the cylinder 01, wherein the first rollers 03 cooperate, by the provision of a first roller support 06, with a first deformable hollow body 04 and the second rollers 29 cooperate by the provision of a second roller support 32, with a second deformable hollow body 33.

The pivoting frame 08 described in the fourth preferred embodiment, as shown in FIG. 4, is preferably disposed so that it is stationary in relation to the cylinder 01, and is parallel to the cylinder's rotational axis. The frame 08 and the guard 47 can be embodied so that when the guard 47 is in the closed position, there is an extremely short distance d47, of preferably between 20 and 25 mm, in an engagement region between the guard 47 and the cylinder 01. When the device is disposed between two cylinders 01 that touch, for example between a plate cylinder and a rubber blanket cylinder of a printing press, the form of the frame 08 and the guard 47 can be embodied so that the device also functions simultaneously as a guard that prevents objects from being pulled in between the two rotating cylinders 01. To this end, a maximal distance of d12=6 mm and/or d47=6 mm should be maintained in the respective outer engagement region between the cylinder 01 and the frame 08 and/or the guard 47, for example between the free end of the leg 12 and the cylinder 01 or, when the guard 47 is open, between the free end of the guard 47 and the cylinder 01. It is advantageous to maintain an obtuse angle toward the operational side in the above-mentioned engagement regions between the cylinder 01 and the pressing device. This can occur by correspondingly configuring the frame 08 and guard 47 or by also providing sheet metal strips, for example.

In a preferred embodiment of the present invention, as is also shown in FIG. 4, a stop 56 is disposed at the end of the leg 12 and is oriented toward the cylinder 01 in order to facilitate an even, guided placement of the printing plate 02 to be installed on the cylinder 01. The stop 56 can be of one piece construction. Preferably, several stops 56 are provided on the frame 08, which several stops 56 are disposed next to each other and which are spaced apart from one another in the longitudinal direction of the frame 08. They are attached to the frame 08 by use of positive and/or frictional engagement devices, for example by the use of screws 57 at a curved lower end of the leg 12. However, the stops 56 can also be part of the leg 12. If the stops 56 are attached to the leg 12 by screws 57, it is advantageous for the stops 56 to be adjustable in relation to the position of the cylinder 01, for example by embodying bores 58 in the leg 12 and through which the screws pass as oblong holes.

On a side 59 of stop 56, which side 59 is oriented toward the cylinder 01 and which cooperates with a leading end 62 of the printing plate 02, the form and position of the stop 56 are embodied in such a way that a distance d56 between the side 59 of the stop 56 and the surface of the cylinder 01 tapers in the circumference direction of the cylinder 01. For example, the side 59 can be embodied of two pieces and so that it is angled in relation to a line 61 extending parallel to the rotation axis of the cylinder 01, wherein the first section of the side 59 disposed in the insertion region of the leading end 62 of the printing plate 02 is inclined less sharply in relation to the cylinder 01 and the subsequent second section is inclined more sharply in relation to the cylinder 01. The distance d56 between the cylinder 01 and the stop 56 should, on the line 61 of the bend 61 or at least in the course of the second section of the side 59, be less than the height d62 of the bent leading end 62 of the printing plate 02.

In accordance with the fourth exemplary embodiment of the device for pressing a packing against a cylinder, in accordance with the present invention, the installation of the packing 02 on the cylinder 01 by use of the device of the present invention takes place as follows: The forme cylinder 01 is initially rotated into a position in which a cylinder groove or channel opening 63 that will receive the bent leading end 62 of the packing, such as a printing plate 02, comes to rest approximately opposite from the stops 56. With its bent leading end 62, the printing plate 02 is inserted between the forme cylinder 01 and the pressing device and is positioned against the stops 56. When the printing plate 02 is inserted or pushed further toward the stops 56, the bent leading end 62 of the printing plate 02 is prestressed by the form of the stops 56 and automatically snaps into the cylinder channel opening 63. After the leading end 62 of the printing plate 02 has been clamped in the channel, the deformable hollow body 04 is acted on with pressure fluid. This opens the guard 47 in response to the movement of the strut 17 and simultaneously places several individually movable rollers 03 against the cylinder 01. If space conditions require, after the leading end 62 of the printing plate 02 is clamped in position and before the opening of the guard 47 and the deployment of the rollers 03, the cylinder 01 can first be repositioned, either in the production direction or in the opposite direction. The repositioning of the cylinder 01 occurs, in an advantageous fashion, so that the rollers 03 are placed against the packing, such as a printing plate 02 either directly on, or close to the channel opening 63 in the cylinder 01. After the rollers 03 are deployed, the cylinder 01 is rotated in the production direction until the rollers 03 again come to rest against the channel 63 and now will guide a trailing plate end into the channel opening 63.

The opening and closing of the locking mechanisms for the leading end 62 of the printing plate or packing 02 and the trailing end of the plate or packing 02 in the channel opening 63 are preferably actuated automatically and are coordinated with the sequence of the above-described procedures of the plate replacement. The removal of the packing 02 from the cylinder 01 essentially occurs in a reverse sequence.

All of the preferred embodiments of the present invention, as set forth above, have the common feature that a single adjusting mechanism 04 or 33 is used to respectively place a number of first rollers 03 and/or a number of second rollers 29, which are actuated simultaneously and directly, against the cylinder 01. This is because the adjusting mechanism, in the form of a deformable hollow body 04, cooperates with the surface 09; 34 of a roller support 06; 32. In all of the preferred embodiments, in the deployed position A, the same force is exerted directly on all of the rollers 03; 29 over the length of the device.

While preferred embodiments of a method and devices for pressing a packing against a cylinder, in accordance with the present invention, have been set forth fully and completely hereinabove, it will be apparent to one of skill in the art that a number of changes in, for example the overall size of the cylinder, the type of rotary printing press used, and the like could be made without departing from the true spirit and scope of the present invention which is accordingly to be limited only by the appended claims.

What is claimed is:

1. A method for pressing a packing against a cylinder including:

providing at least one roller;

providing an adjusting mechanism for deploying and retracting said roller;

providing an actuatable guard for covering said roller in a direction of the cylinder; and actuating said guard and said at least one roller using said adjusting mechanism.

2. A device adapted to press a packing against a cylinder comprising:

at least one roller supported for deployment and retraction with respect to the cylinder;

an adjusting mechanism useable to accomplish said deployment and said retraction of said at least one roller; and an actuatable guard useable to cover said roller in a direction of the cylinder, said actuatable guard being actuated with said roller by said adjusting mechanism.

3. The device of claim 2 further including a stationary pivot axis, said guard being disposed for pivotal movement about said stationary pivot axis.

4. The device of claim 3 wherein said at least one roller has a roller axle of rotation and further wherein said stationary pivot axis is generally parallel to said roller axle of rotation.

5. The device of claim 2 wherein said guard is actuatable directly by said adjusting mechanism.

6. The device of claim 2 further including a linkage system between said guard and said adjusting mechanism.

7. The device of claim 2 further including a roller support, said roller support supporting a plurality of said rollers, said guard being coupled to said roller support.

8. The device of claim 7 further including a coupler, said coupler extending between said guard and said roller support and being connected in a pivotable manner to both guard and said roller support.

9. The device of claim 2 wherein said adjusting mechanism is a reversibly deformable hollow body, said hollow body being adapted to be acted on by a fluid under pressure.

* * * * *